United States Patent [19]

Watanabe

[11] 3,985,612

[45] Oct. 12, 1976

[54] PAPER MAKING SYSTEM INCLUDING FORMING FABRICS AND POROUS FORMING CYLINDERS

[76] Inventor: Kazumasa Watanabe, 82-1, Iriyamase, Fuji, Shizuoka, Japan

[22] Filed: Aug. 25, 1975

[21] Appl. No.: 607,824

Related U.S. Application Data

[63] Continuation-in-part of Ser. No. 421,798, Dec. 5, 1973, abandoned.

[30] Foreign Application Priority Data

Mar. 12, 1973 Japan ..... 48-28782

[52] U.S. Cl. ..... 162/203; 162/133; 162/209; 162/299; 162/303; 162/304; 162/306

[51] Int. Cl.[2] ..... D21F 9/02; D21F 11/04

[58] Field of Search ..... 162/203, 298, 299, 301, 162/304, 303, 306, 317, 318, 133, 209, 352, 358

[56] References Cited

UNITED STATES PATENTS

| | | | |
|---|---|---|---|
| 3,201,305 | 8/1965 | Webster | 162/203 |
| 3,432,385 | 3/1969 | Thorp | 162/352 |
| 3,547,777 | 12/1970 | De Noyer | 162/303 |
| 3,681,193 | 8/1972 | Nykopp | 162/133 X |
| 3,726,758 | 4/1973 | Parker et al. | 162/299 |
| 3,752,734 | 8/1973 | Notbohm | 162/299 X |
| 3,772,140 | 11/1973 | Kobayashi | 162/133 |
| 3,846,232 | 11/1974 | Kankaanpaa | 162/301 |

*Primary Examiner*—S. Leon Bashore
*Assistant Examiner*—Richard V. Fisher
*Attorney, Agent, or Firm*—Wenderoth, Lind & Ponack

[57] ABSTRACT

A paper forming machine includes at least one porous rotatable cylinder. An inner forming fabric or media in mesh form (hereinafter referred to as "inner forming media") is guided through a path around the cylinder and has a straight portion immediately before the cylinder. An outer forming fabric or media in mesh form (hereinafter referred to as "outer forming media") is guided so as to form a closing angle over the straight path of the inner forming media toward the uppermost portion of the cylinder, and is guided around a portion of the cylinder over the inner forming media and through a path in juxtaposition with the inner forming media leading away from the cylinder. Paper is formed by depositing a paper forming material slurry on the straight portion of the inner forming media which is porous so that the slurry becomes partly dehydrated and the fibers become oriented in the direction of movement. The paper forming slurry then enters into the space between the inner and outer forming media at which they close together. The slurry loses additional moisture during its travel around a portion of the cylinder at which time the slurry is compressed to remove the remaining liquid therefrom. The formed paper may be guided on the inner forming media over another cylinder which is also contacted by a conveyor fabric. The machine may also be constructed with two sets of inner and outer forming media and rotatable porous cylinders which cooperate with a conveyor fabric which moves successively into association with the respective second porous cylinders engaged by each respective inner forming media.

2 Claims, 6 Drawing Figures

PAPER MAKING SYSTEM INCLUDING FORMING FABRICS AND POROUS FORMING CYLINDERS

This is a continuation-in-part of application Ser. No. 421,798, filed Dec. 5, 1973, now abandoned.

BACKGROUND OF THE INVENTION

The present invention relates to a paper making machine. More particularly, the present invention relates to a paper making machine including a wet paper layer forming portion.

Paper making machines of the Fourdrinier and cylinder types have primarily been heretofore employed in the paper making industry. These machines, however, have the common drawback that the manufactured paper sheets tend to curl in the transverse direction and that the entire machine tends to be enlarged in scale. For example, in the Fourdrinier paper making machine, a paper material slurry is supplied onto an endless elongated forming fabric through stock inlets at substantially the same speed as the moving speed of the elongated forming fabric, and the primary dehydration of the paper material slurry is conducted at a horizontal portion of the moving elongated forming fabric by the effect of gravity and by suction of suction boxes. In recent years, the elongated forming fabric has been operated at higher speeds for the purpose of improving productivity. For this reason, the following drawbacks have resulted. There is caused a speed differential between the elongated forming fabric and the paper material slurry supplied thereto, the direction of orientation of the fibers in the material slurry inevitably tending to be directed in the direction of movement of the elongated forming fabric, whereby the paper sheets after manufacture curl in the transverse direction. Further, in keeping with the acceleration of the paper manufacturing speed, the dehydration section must be made increasingly longer. Consequently, the length of the horizontal portion of the elongated forming fabric must be increased, and the overall machine thus becomes larger. Furthermore, the suction box is made to contact the inner surface of the elongated forming fabric during the suction and dehydration processes, whereby the frictional force between the suction box and the elongated forming fabric represents a load which not only increases the quantity of power consumed, but also causes abrasion of the elongated forming fabric, thereby shortening the life thereof. These defects cause the manufacturing cost of the paper to be increased. What is worse, substantial noise pollution is caused by the operation of a number of suction boxes.

SUMMARY OF THE INVENTION

With the above discussion in mind, the object of the present invention is to eliminate the above-mentioned drawbacks.

Paper sheets obtained by the novel paper making machine in accordance with the present invention have the most remarkable characteristic in that such paper sheets have upper and lower layers or surfaces which are different from each other. This fact is not only extremely effective in the prevention of curling in the transverse direction, but also is advantageous in simplifying processing of the paper sheets. Further, the paper sheets have a tensile strength which is uniform in both the transverse and longitudinal directions, and such strength is increased. Moreover, the paper making machine in accordance with the present invention is characterized in that fiber flocks automatically disappear during the process of forming wet paper sheets, high paper quality is constantly maintained, and the production of paper sheets having poor quality is reduced to substantially zero. It is another characteristic feature of the present invention that there are provided separate circuits of inner and outer forming fabrics which overlap over an area or length sufficient for forming paper sheets. Over a portion of such overlapped length the overlapped forming fabrics contact a portion of the circumferential outer surface of a porous cylinder roll. All of the operations in the formation of wet paper sheets are performed around the porous cylinder roll. Thus, the size of the overall machine may be remarkably reduced, and the machine can be disposed in a space which is only a small fraction of the size needed for conventional machines. This fact is advantageous, particularly in cases where a unit including a plurality of paper making machines must be installed in a limited space.

It is still another characteristic feature of the present invention that the surface pressure exerted by the inner and outer forming fabrics, the dehydration action by centrifugal force and the porosity of the cylinder roll synergistically act on the paper layers at the paper layer forming area formed around the porous cylinder roll, which very effectively results in formation of the paper sheet. This is explained in more detail hereinbelow. The paper material slurry supplied to the starting point of the overlapped area of the inner and outer forming fabrics is substantially dehydrated by the above mentioned factors while passing through the paper layer forming area upon reaching the terminal portion of such overlapped area. The paper layer forming area occupies merely a portion of the circumferential surface of the porous cylinder roll, which portion is an extremely short distance in most cases. The dehydration occurring during this process can certainly be said to be remarkable. This fact brings about very desirable results. For example, in accordance with the paper making machine of the present invention, it can be considered as one of the noticeable characteristic features thereof that there is no need for the use of suction boxes to achieve suction and dehydration. One of the unsolved problems of conventional paper making machines has been, as mentioned hereinabove, noise pollution resulting from the use of suction boxes as well as the abrasion of the elongated forming fabrics. Further, the consumption of electric power by the use of the suction boxes has been a great percentage of the entire consumption of electric power. Since the present invention does not include the use of suction boxes, the present invention provides the advantages of great reduction of electric power consumption, elimination of noise pollution, warranty of the long life of the forming fabrics and the like. These advantages, of course, immediately result in the great reduction of installation investment expenses as well as the cost of the finished products.

It is still another characteristic feature of the novel paper making machine in accordance with the present invention that it is possible to accelerate the paper manufacturing speed to a very high rate, and on the contrary to decelerate the same to a very low rate. For instance, this can be verified by the fact that it is possible to conduct the paper manufacturing process at a very wide range of speeds, such as speeds of from 130 meters to 600 meters per minute.

These and other features of the present invention will be fully understood from the following description of the structure of the novel paper making machine, as well as the actions and effects thereof, of the present invention. The following description of the present invention merely shows preferred embodiments thereof, and should not be construed as limiting the scope of the present invention.

BRIEF DESCRIPTION OF THE DRAWINGS

The accompanying drawings illustrate representative embodiments of the novel paper making machine in accordance with the present invention in which.

DESCRIPTION OF THE PREFERRED EMBODIMENTS

Figure 1:
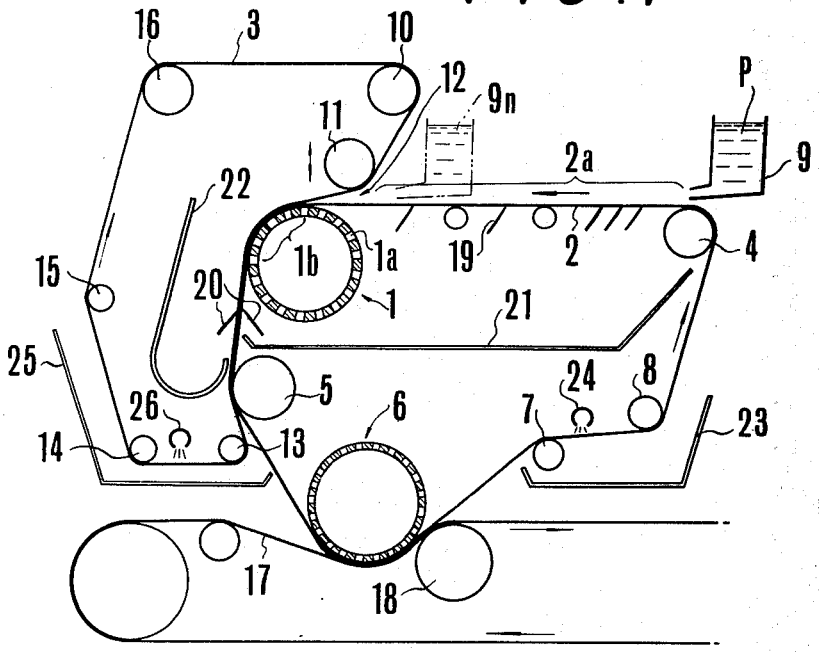
FIG. 1 is a diagrammatically sectional view showing the structure of the entire machine of the present invention.

In the accompanying drawings, reference numeral 1 denotes a porous cylinder roll to which high speed rotation is directly or indirectly provided. Porous cylinder roll 1 may be, for example, a cylinder having a smooth surface provided with numerous pores extending through the wall thereof, or a cylinder in a mesh form which is woven with fiber or similar material, and has a structure wherein water may freely pass through numerous pores 1*a*. Reference numeral 2 denotes an inner forming media, such as a forming fabric or wire, in a mesh form and having an inner wall engaged with the outer circumference of the porous cylinder roll 1. The inner forming media 2 engages roll 1 from the vicinity of the upper dead center, or uppermost position, of porous cylinder roll 1, has a straight moving portion 2*a* of a short section extending tangentially to the cylinder roll, and is guided over a breast roll 4 and a circular arc face or portion of the circumference of the porous cylinder roll 1. The inner forming media 2 is further guided rotationally over an attaching or transfer roll 5 which biases the inner forming media 2 outwardly. The inner forming media 2 is also guided over a porous cylinder roll 6, and guide rolls 7 and 8, and back to the breast roll 4.

A conveyor means, such as fabric 17, for conveying paper layers engages with a lower circular arc surface or portion of the circumference of the porous cylinder roll 6 so as to hold the inner forming media 2 therebetween. The conveyor fabric 17 and the inner forming media 2 are pressed together at the terminal portions of the area of mutual engagement between the conveyor fabric 17 and the inner forming media 2 along the surface of the porous cylinder roll 6. A biasing roll 18 biases the conveyor fabric 17 toward the inner forming media 2.

In accordance with the present invention, there is provided an outer forming media 3, such as a forming fabric or wire, in a mesh form, which is part of another guide circuit and which is guided over a circular arc surface or portion of the circumference of the roll 1 over the inner forming media 2. The outer forming media 3 approaches roll 1 obliquely toward an upper portion of the porous cylinder roll 1 and is guided over a turn roll 10 and a roll 11 for adjusting the angle of entry of the outer forming media 3 to roll 1. Outer forming media 3 overlaps the inner forming media 2 in the vicinity of the upper dead center or the uppermost portion of the porous cylinder roll. The roll 11 is movably mounted and is constructed in such a manner that it applies tension upwardly or downwardly in accordance with the paper fabric to be manufactured. Adjustment of the position of roll 11 thereby varies the angle of entry of the outer forming media 3, and thus the angle $\alpha$ of an entrance 12 which is to be taken by the paper forming material, and which is formed by the inner and outer forming media 2 and 3. In addition to the shifting of the roll 11, the angle of entry and the angle of entrance 12 may also be adjusted by shifting the turn roll 10. It is also possible to adjust the angle of approach between the outer forming media 3 and the inner forming media 2 by moving the breast roll 4 of the inner forming media 2. Moreover, other angle adjusting means, which will be apparent to those skilled in the art, may be provided.

Thus, the entrance 12 for the paper forming material, which entrance is closed at a determined angle $\alpha$, is formed near the upper dead center or uppermost portion of the porous cylinder roll 1 by the engagement between inner and outer forming media 2 and 3. An area 1*b*, over which a paper layer is formed between the overlapping of the inner and outer forming media 2 and 3 along a circular arc surface of porous cylinder roll 1, extends from the vicinity of the upper dead center of the porous cylinder roll 1 around the surface thereof. In area 1*b*, the paper layers are formed by the dehydration and pressing of paper layer material under the influence of the action of the centrifugal force of the porous cylinder roll 1 and the surface pressure of the inner and outer forming media.

With reference to the accompanying drawings, the conditions of the inner and outer forming media 2 and 3 after passage along area 1*b* are as follows. The inner and outer forming media 2 and 3 are extended in the tangential direction of the porous cylinder roll 1, with the outer forming media 3 being guided by the turn roll 13 at the point where the outer forming media has passed by the circular arc suface of the attaching roll 5. The outer forming media is then guided to the turn roll 10 over guide rolls 14, 15 and 16. By providing the turn roll 13 in such position, the dehydrated paper layer can easily be transferred onto the inner forming media 2 by the surface pressure of the outer forming media 3 against the inner forming media 2 at the outer circular arc surface of the attaching or transfer roll 5, even when the paper machine according to the present invention is operated at a high speed, without applying suction from the transfer roll to the paper sheet.

Figure 2:
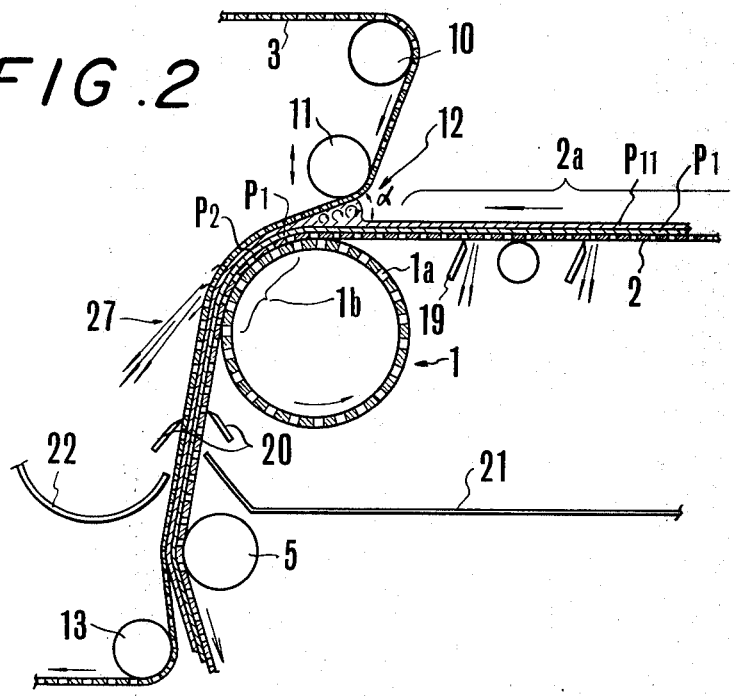
FIG. 2 is an enlarged sectional view showing the process of forming paper layers.

As shown in FIG. 2, drain doctor blades 19 are provided in contact with the lower surface of the straight moving portion 2*a* of the inner forming media 2. In addition, drain doctor blades 20 are providing for removing impure water adhered to the inner and outer forming media 2 and 3, respectively. The drain doctor blades 20 arc in contact with the outer surfaces of the inner and outer forming media 2 and 3 at spaced locations from the porous cylinder roll 1. Reference numeral 21 denotes a drain or collecting receptacle for receiving mainly liquid from the straight moving portion 2*a* of the inner forming media 2, and 22 is a trough for receiving liquid discharged by the action of the centrifugal force of the porous cylinder roll 1. A trough 23 is provided for receiving the cleansing water coming out of a cleansing nozzle 24 provided for cleaning the inner forming media 2, and a trough 25 is provided for receiving cleansing water discharged out of a cleansing nozzle 26 provided for cleaning the outer forming media 3.

Stock inlets or pulp head boxes 9 are arranged to discharge paper material slurry P over the straight moving portion 2*a* of the inner forming media 2, and the paper material slurry P flows over the inner forming media 2 while it is moved at a high speed so that there is a water flow in the form of a uniform thin film. Thus, the paper material slurry is subjected to the influence of the high speed movement of the inner forming media 2, of air resistance and of the action of inertia.

Thus, a paper layer $P_1$ with fibers having an orientation in the same direction as the direction of movement of the inner forming media 2 is formed while passing through the very short straight moving portion 2*a* of the inner forming media 2, where such layer $P_1$ is subjected to prehydration by the gravity of paper material slurry and the action of the drain doctor blades 19.

The paper material slurry is rapidly supplied to the entrance 12 of the paper forming area 1*b* at the terminal portion of the straight moving portion 2*a*, and the upper surface of the material supplied thereto contains large content of the paper material slurry. In this way, the residual material in the slurry on the surface of the paper layer $P_1$ is rapidly led into the entrance 12 which is closed towards the nip of the overlapping contact between the inner and outer forming media. At this nip the slurry is subjected to strong resistance, against the direction of movement thereof, along the inclined face of the outer forming media 3. For this reason the slurry $P_{11}$ flows in a turbulent state along the narrowing entrance 12, as illustrated in FIG. 2. The residual slurry $P_{11}$ on the surface of the paper layer $P_1$ is continuously influenced by the phenomenon of the turbulent flow as the paper is led into the area 1b on the circular arc face of the porous cylinder roll 1 by the converging of the inner and outer forming media. The paper is rapidly dehydrated by the influences of the pressure of both the inner and outer forming media 2 and 3, the numerous pores 1a of the porous cylinder roll 1 and the action of centrifugal force. These combined influences form a paper layer $P_2$ the fibers of which are dispersed or randomly oriented, such layer $P_2$ being integral with layer $P_1$ the fibers of which are oriented in the direction of travel.

Figure 5:
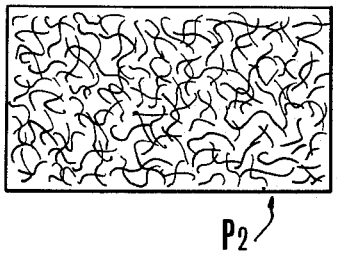
FIGS. 5 and 6 are enlarged views respectively showing the orientation of the fibers in the upper and lower surfaces of the paper layers formed by the paper making machine of the present invention.
Figure 6:
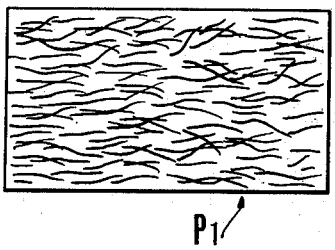

FIGS. 5 and 6 illustrate a formed paper sheet including paper layers $P_1$ and $P_2$. The arrangement of the paper layer the fibers of which are dispersed in all directions is shown in FIG. 5, and the layer the fibers of which extend in the direction of movement as shown in FIG. 6. Thereby, the paper sheet made in accordance with the method of the present invention does not curl in any direction and has the advantages that the tensile strength in both the transverse and longitudinal directions is uniform and that the paper sheet is difficult to tear. Further, since the paper material slurry flows in a turbulent state through the entrance 12 of the forming paper forming area 1*b*, fiber flocks automatically disappear. For this reason, such advantages are obtained that the surface of the manufactured paper sheet is extremely fine, and there is no inferior product manufactured. In conventional paper mmachines, a mass of fibers in the paper material slurry will result in the formation of uneven paper layers, and what is worse, such masses of fibers form sectional holes in the paper sheet. These defects have been eliminated by the aforementioned arrangement of the present invention.

The dehydration property at the paper layer forming area 1b over the porous cylinder roll 1 and between the inner and outer forming media 2 and 3 is surprisingly great, and substantially most of any impure water contained in the paper layer is removed at this area. Therefore, there is no need of dehydration by means of suction boxes as required in prior art machines. Impure water tends to pass in a large quantity into the inner surface of the porous cyclinder roll through the inner surface of the inner forming media and the pores 1a under the surface pressure of the inner and outer forming media 2 and 3 is dehydrated at a highly accelerated force in the direction of the outer forming media as illustrated by arrows 27 in FIG. 2 by the synergistic action of the centrifugal force of the porous cylinder roll 1. Thus, there is no dispersion or dropping of the water. The more the paper manufacturing speed is increased, the greater the dehydration effect becomes.

In accordance with the method of the present invention, a paper layer is formed by the preliminary dehydration along the straight moving portion 2*a*, and a primary dehydrating action is carried out at the paper layer forming area 1*b*. Because suction dehydration is not required, the electric power required is greatly reduced, and also loss of power due to abrasion of the forming media due to contact between suction boxes and the forming media which travel at high speed operation is lessened, and the wear and damage of the forming media caused by such contact have been substantially reduced. Further, very quiet operation can be achieved without the use of suction boxes which are a source of noise.

In conventional paper making machines, a paper layer once dehydrated is transferred by contact with a pick-up roll to a felt containing water from a shower means. Thus, conventional paper making machines have the defect that a paper layer once dehydrated is contacted by elements which again cause the paper layer to contain water.

In consideration of such defect, the present invention is provided with the biasing roll 18 at a position where the conveyor fabric 17 is biased thereby toward the inner forming media 2 after passing through a circular arc surface of a portion of the circumference of the porous cylinder roll 6 together with the inner forming media 2. Thus, a pick-up roll is not required, and the paper layer can easily be transferred onto the conveyor fabric 17 in a dehydrated state by the surface pressure of the inner forming media 2 against the conveyor fabric 17 along a circular arc surface of the porous cylinder roll 6, even when the paper machine of the present invention is operated at a high speed, without applying suction from the biasing roll to the paper sheet.

Figure 4:
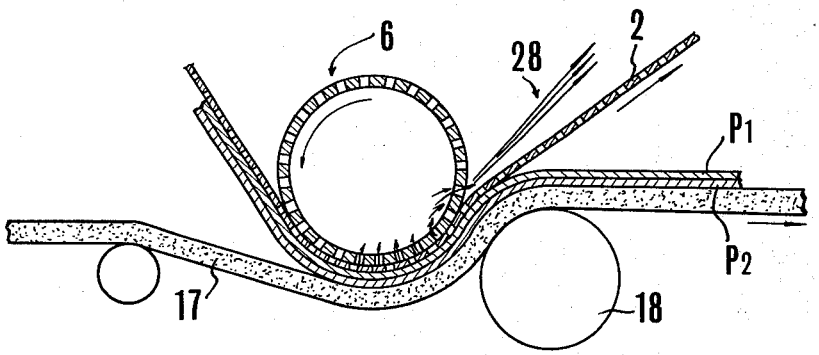
FIG. 4 is an enlarged sectional view showing the manner in which paper layers are rotationally transferred to a conveyor fabric or media from a second porous cylinder roll.

Impure water directed into the inner surface of the porous cylinder roll 6 by the surface pressure of the conveyor fabric 17 and the line pressure of the rotating biasing roll 18, as illustrated in FIG. 4, is pushed out in such a manner as to run along the inner forming fabric 2, as shown by arrows 28, by the action of centrifugal force of porous cylinder roll 6, and such water then drops down into the trough 23. Accordingly, the paper sheet rotationally transferred onto the conveyor fabric 17 is never damaged.

The porous cylinder rolls 1 and 6 can be applied in multistages in cases where the paper layer is thick and contains a large amount of water. However, the paper sheet may be formed by the use of only a single main porous cylinder roll 1, without using the second porous cylinder roll 6. It is also possible to rotationally transfer the paper sheet onto the conveyor fabric 17 directly from the main porous cylinder roll 1.

Figure 3:
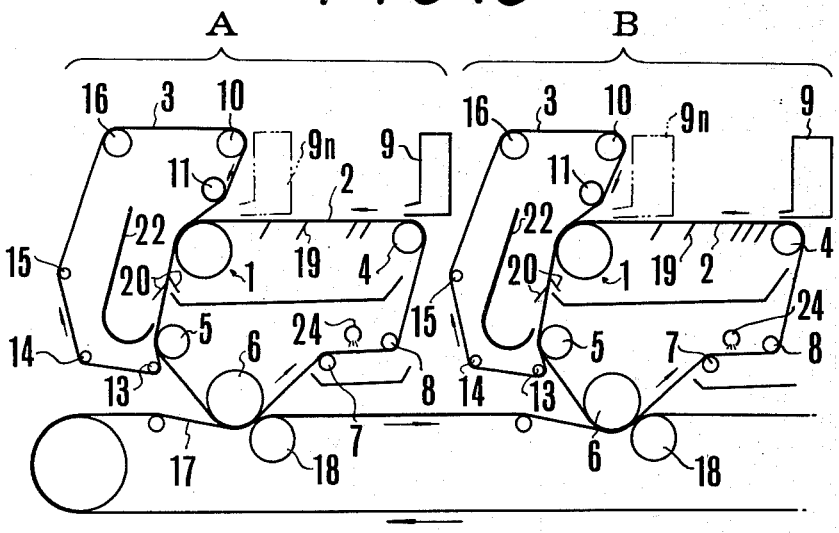
FIG. 3 is a diagrammatically sectional view illustrating a unit comprised of a plurality of paper making machines of the present invention.

FIG. 3 shows another embodiment of the present invention in which two units A and B of the type of machine shown in FIGS. 1 and 2 are combined. The paper sheets formed by the respective units A and B are successively overlapped on the mutual conveyor fabric 17. The paper thus obtained has alternate layers with oriented fibers and non-oriented fibers, so that the combined sheet has a tensile strength which is remarkably strong and also has an exceptional resistance to curling. Further, more than two stock inlets or head boxes 9 may be provided to discharge slurry onto the inner forming media at spaced locations. Other stock inlets are shown by **9*n* in FIG. 1 and FIG. 3. In accordance with this method, the paper forming material slurry is supplied at a plurality of locations so that it is overlapped onto the inner forming media 2. The paper forming material slurry supplied from the first stock inlet 9 is dehydrated by gravity at the straight moving portion 2*a*, as in the previous embodiment, and the lower layer has fibers which have an orientation in the direction of travel. The paper forming material slurry supplied from the second stock inlet is subjected to the previously mentioned action in the entrance 12 and is rapidly held under pressure in the paper layer forming area 1*b* to become an integral paper layer with the upper layer $P_2$ having non-oriented fibers. In this case, it is possible to manufacture paper sheets having upper and lower layers of different thickness by the adjustment of the quantity of the paper material slurry to be supplied from the first and second stock inlets. Further, it is possible to overlap paper material slurry from the respective stock inlets 9 and 9*n*** by using different kinds of slurry, thereby enabling the manufacture of paper having upper and lower surfaces of different qualities.

As will be fully understood from each of the above embodiments, the basic portions of the novel paper making machine of the present invention having a wet paper forming portion result in the advantage that the machine can be located in a compact manner with a very short transverse width. The paths of the inner and outer forming fabrics or media are such that they need merely provide a space large enough for the diameter of the porous cylinder roll and for formation of the straight paper layer forming area. The novel paper making machine of the present invention requires only a length which is several times shorter than the conventional Fourdrinier machine and still provides an excellent dehydration effect.

What is claimed is:

1. A method of forming a paper web from a slurry material without the use of suction boxes, said method comprising:

passing an inner paper forming fabric in mesh form over an arc surface of the outer circumference of a first rotatable porous cylinder roll, said inner paper forming fabric having a straight moving section extending tangentially to the uppermost position of said first roll;

passing an outer paper forming fabric in mesh form overlapping said inner paper forming fabric along the outer circumference of said first roll and forming with said inner paper forming fabric along a portion of the outer circumference of said first roll a paper layer forming area, said outer paper forming fabric extending tangentially to said uppermost portion of said first roll at an angle to said inner paper forming fabric;

directing a slurry of paper forming material onto said straight moving section of said inner paper forming fabric at a location before it closes with said outer paper forming fabric and thereon dehydrating said slurry by the action of gravity and without suction boxes to form a partly dehydrated slurry, with the fibres at the bottom thereof oriented in the direction of travel of said inner paper forming fabric;

moving the partly dehydrated slurry into the closing area formed between said inner and outer paper forming fabrics and subjecting the partly dehydrated slurry to turbulence such that the fibres at the top thereof become randomly oriented;

moving said partly dehydrated slurry over the surface of said first roll through said paper layer forming area while compressing said partly dehydrated slurry between said inner and outer paper forming fabrics as it is moved over the surface of the cylinder, and removing additional moisture therefrom entirely by the compressing action of said inner and outer paper forming fabrics and the centrifugal force action produced by the movement of the dehydrated slurry around the surface of said first roll, and thereby forming a paper web from the thus dehydrated slurry;

passing said inner and outer paper forming fabrics with said paper web therebetween tangentially from said first roll and tangentially over a portion of the outer surface of a transfer roll;

separating one of said inner and outer paper forming fabrics from said paper web and the other of said paper forming fabrics, while maintaining said paper web on said other paper forming fabric without the application of suction from said transfer roll;

passing said other paper forming fabric with said paper web over an arc surface of the outer circumference of a second rotatable porous roller;

passing a conveyor fabric, in overlapping manner over said other paper forming fabric with said paper web therebetween, along said arc surface of said second roll, and removing still remaining moisture from said paper web by the centrifugal force of said second roll and the surface pressure of said conveyor fabric and said other paper forming fabric;

passing said conveyor fabric and said other paper forming fabric with said paper web therebetween over a portion of the outer circumference of a biasing roll; and separating said other paper forming fabric from said paper web and said conveyor fabric, while maintaining said paper web on said conveyor fabric without the application of suction from said biasing roll.

2. A paper forming machine comprising in combination:

a first rotatable porous cylinder roll;

an inner paper forming fabric in a mesh form engaged with said first roll along an arc surface of the outer circumference thereof and having a straight moving section extending tangentially to said first roll from a position adjacent the uppermost position of said first roll;

at least one slurry head box for supplying a paper slurry onto said straight moving section, whereat said slurry is preliminarily dehydrated by gravity;

an outer paper forming fabric in a mesh form overlapping said inner fabric along the outer circumference of said first roll from a position adjacent said uppermost position of said first roll and forming therewith along a portion of the outer circumference of said first roll a paper layer forming area, whereat the preliminarily dehydrated slurry is primarily dehydrated by the centrifugal force of said first roll and the surface pressure of said inner and outer fabrics to thereby form a paper web;

a transfer roll, said inner and outer fabrics, after being guided tangentially from said first roll, extending to and engaging in an overlapping condition a portion of the outer circumference of said transfer roll, said inner and outer fabrics holding said paper web therebetween at said portion, said inner and outer fabrics being thereafter separated from each other by the surface pressure thereof, and said paper web being transferred from one of said inner and outer fabrics to the other said fabric without applying suction from said transfer roll to said paper web;

a second rotatable porous cylinder roll, the other said fabric onto which said paper web is transferred engaging over an arc surface of the other circumference of said second roll;

a conveyor fabric overlapping said other fabric, with said paper web therebetween, along said arc surface of said second roll and forming therewith a section where still remaining moisture is removed from said paper web by the centrifugal force of said second roll and surface pressure of said conveyor fabric and said other fabric; and a biasing roll, said conveyor fabric and said other fabric, after being guided tangentially from said second roll, extending to and engaging over a portion of the outer circumference of said biasing roll, said conveyor fabric and other fabric holding said paper web therebetween at said portion and said resultant paper web being transferred from said other fabric to said conveyor fabric without applying suction from said biasing roll to said resultant paper web.

* * * * *